United States Patent [19]

Bormke et al.

[11] 4,288,313

[45] Sep. 8, 1981

[54] HANGER FOR HANDLING SHEET MATERIAL DURING PROCESSING THEREOF

[75] Inventors: Odo S. Bormke, Gig Harbor; Ronald L. Bunch, Tacoma, both of Wash.

[73] Assignee: The Boeing Company, Seattle, Wash.

[21] Appl. No.: 138,665

[22] Filed: Apr. 9, 1980

[51] Int. Cl.[3] ..... C25B 9/02; C25D 17/08

[52] U.S. Cl. ..... 204/297 W; 118/500; 211/118; 204/286

[58] Field of Search ..... 204/286, 297 R, 297 W; 118/500; 211/118

[56] References Cited

U.S. PATENT DOCUMENTS

| | | | |
|---|---|---|---|
| 2,248,718 | 7/1941 | Owen | 204/297 R X |
| 4,077,865 | 3/1978 | Muller | 204/297 W |

*Primary Examiner*—F. Edmundson

*Attorney, Agent, or Firm*—Christensen, O'Connor, Johnson & Kindness

[57] ABSTRACT

In order to hang sheet material, such as an aluminum skin section of an aircraft, during processing thereof, a plurality of hangers are provided, for releasably engaging an upper edge of the sheet material at spaced locations therealong so as to provide, in one mode, points of attachment for connection of the sheet material to an overhead support or hoist, and to provide in another mode, lateral abuttments for straddling a pair of elevated, spaced parallel rails to hand the sheet material therebetween while awaiting the next processing operation. The body of the hanger has an inverted Y-shape wherein the downwardly oriented leg portions are separated by a vertical slot for receiving the upper edge of the sheet. A releasable shear pin held in the legs of the hanger body is passed through a pin receiving hole provided in the sheet adjacent the upper edge thereof when such sheet edge is inserted in the hanger slot. An upwardly projecting lug portion on the hanger body serves as the point of attachment to the overhead support or hoist, and the downwardly oriented legs form spaced feet for supportively resting on the above-mentioned spaced parallel rails. The hanger body is made of an electrically conductive metal, such as aluminum, to serve as an electrical connection to the sheet during electroprocessing thereof, and a clamping screw threaded into a leg of the hanger body, but electrically insulated therefrom, clamps the sheet to an interior surface of the hanger slot for achieving positive electrical contact between the metal sheet and the hanger body while protecting the screw threads from electrochemical corrosion.

17 Claims, 9 Drawing Figures

Fig. 4.
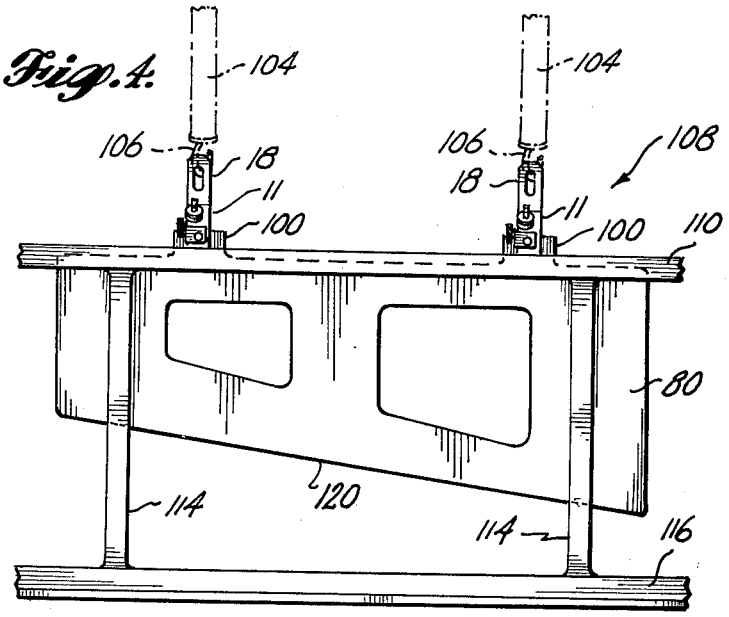
Fig. 5.
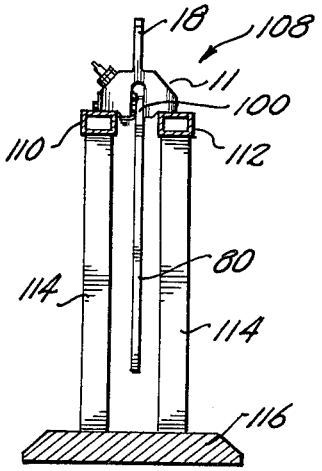
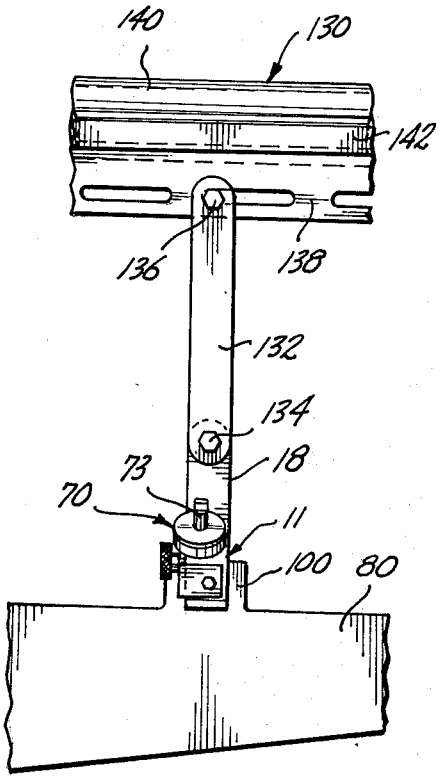
Fig. 6.
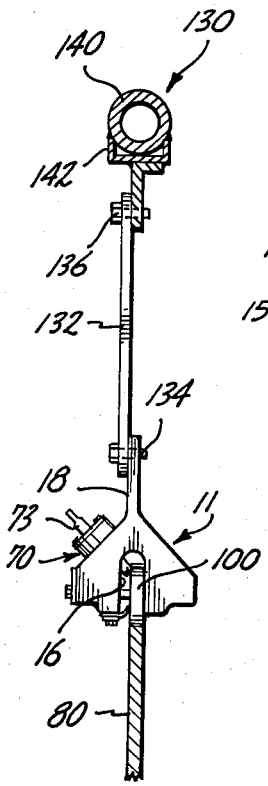
Fig. 7.
Fig. 8.
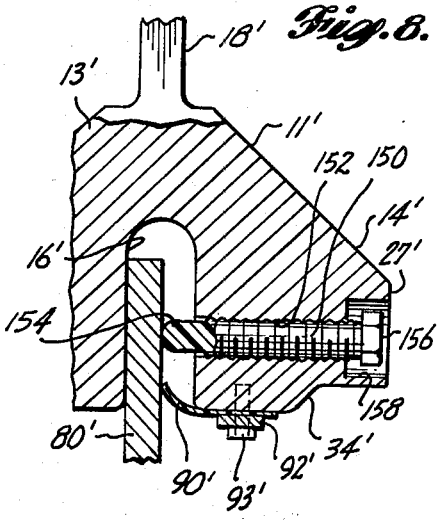
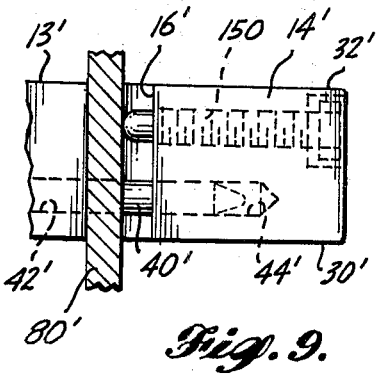
Fig. 9.

HANGER FOR HANDLING SHEET MATERIAL DURING PROCESSING THEREOF

BACKGROUND OF THE INVENTION

In general the invention relates to the handling and processing of sheet materials, and more particularly to apparatus for hanging such sheets from an upper edge thereof during processing, transporting and storage.

The handling of relatively large sheet material, especially heavy metal sheets, such as the aluminum skin sections used to construct the body of an aircraft, involves numerous problems in supporting and moving the sheets from the initial milling operation through the various downstream processing stages. Such downstream operations may, for example, include shot peening, electroprocessing, painting and curing. To efficiently schedule these processing operations, it is necessary to store the sheets temporarily between processes and, hence, the sheet material must be frequently moved to the storage locations and retrieved therefrom quickly and efficiently without damaging the partially processed sheet.

Heretofore, heavy metal sheets of relatively large planar dimensions, have been handled by attaching inverted U-brackets, each with a shear bolt and wing nut, to holes provided at spaced locations along the upper edge of the sheet. The brackets are in turn supported from above by steel cables that depend downwardly from rachet drums and that are looped through the inverted U-bracket. These U-brackets, steel cables and rachet drums are however not capable of constraining the sheet to a planar configuration, and twisting of the cables and the brackets has frequently resulted in buckling of the sheet along the supported edge. Sheet buckling sometimes caused permanent deformation to the skin section, and in other cases hindered uniform treatment of the skin faces such as when they were painted by the use of automatic spray guns. Furthermore, to store the sheets between processing stages, it has been necessary to lower the sheets between stanchions and rest the lower sheet edges on bottom stops, subjecting the sheets, especially the lower edges thereof, to scratching, galling and other surface damage. Also, the inverted U-brackets cannot in all cases be left on the partially processed sheet, and removal and reattachment of the bracket bolts required significant operator time.

When the sheet material, such as the aluminum skins for an aircraft body, requires electroplating or anodizing as one of the processes, the inverted U-brackets, cables and rachet drums have been used to support the sheet in the electrochemical bath, and separate clamping electrodes have been attached to the sheet to apply the necessary electrical potential thereto. To first attach, and then after the electroprocessing, disconnect the separate electrodes, added undue delay to the electroprocessing operation. Moreover, the rachet drum cables used to support the U-shaped brackets were made of steel in order to provide needed strength and flexibility, and the electrochemicals used during the sheet anodizing operations quickly corroded the cables, making them difficult to use and required frequent replacement.

Accordingly, an object of the invention is to provide a device for hanging sheet material from an upper edge thereof during multistep processing of the sheet material wherein the device is quickly attachable and detachable from the sheet, and is capable of supporting the sheet from an overhead hoist or the like, and is equally capable of supporting the sheet in downwardly depending relation from a pair of elevated and spaced parallel rails.

A further object of the invention is to provide such a sheet hanging device, made of an electrically conductive metal, and incorporating a screw clamp that is used during electroprocessing of a metal sheet material, to force the sheet into positive electrical contact with the body of the hanging device for applying the necessary electrical charge to the sheet through such device, and is itself constructed so as to resist damage due to electrochemical corrosion.

Still another object of the invention is to provide such a hanging device having the capability of being attached, along with a plurality of like hanging devices, to a sheet of material, at an early stage of successive processing steps for use in transporting the sheet to and from each processing station, and for storing the sheet between processing stages.

An additional object is to provide a hanger device, capable of cooperating with a plurality of like hanger devices so that when attached to an upper edge of a relatively large and flexible sheet of material, the hanger devices constrain the sheet to a generally planar configuration to resist buckling of the sheet.

SUMMARY OF THE INVENTION

These and other objects, features and advantages of the invention are provided by a hanger for supporting sheet material during handling, storage and processing thereof wherein the sheet is provided with an opening transverse to the plane of the sheet and adjacent one edge thereof for cooperating with a releasable shear pin that forms a component of the hanger. The body of the hanger is generally Y-shaped and inverted so as to define downwardly oriented first and second legs, the inwardly confronting surfaces of which bound a centrally disposed sheet receiving slot. Above the slot, the hanger body projects upwardly in the form of an attachment lug that in turn is provided with a transverse opening for receiving a cooperating fitting, for connection to an overhead support, such as a hoist. The lower extents of the first and second legs provide feet that serve as laterally opposed abuttments for supportively resting on elevated and spaced supports, such as parallel rails, for temporary storage of the sheet material between processing stages.

The releasable shear pin is incorporated into the body of the hanger so as to slide through a pin receiving opening in one hanger leg, thence through a registering hole in the sheet material when it has been inserted into the hanger slot, and project into a pin receiving opening in the other hanger leg.

In a preferred form, the hanger is used for electroprocessing of the supported sheet, and the hanger body is made of a conductive metal. In such embodiment, a clamping screw is provided, disposed adjacent the shear pin, and arranged adjacent the releasable shear pin is a clamping screw cooperating with the hanger body so as to adjustably project into the slot. The clamping screw is oriented relative to the slot so that when tightened, one end of the screw travels into the slot so as to jam the sheet material against an opposing interior surface of the slot to achieve a positive electrical contact between the sheet and hanger body.

Also, in accordance with the preferred form of the invention, the clamping screw is constructed and mounted so that there is no electrical current flow from the screw to the hanger body across the screw threads. This construction prevents corrosion of the threads due to electrochemical effects in the environment of an electroprocessing operation. Hence, the clamping screw in this preferred embodiment serves as an electrically inert member that acts to physically jam the sheet material against the interior slot surface of the hanger body so that electrical current flows across this point of contact rather than through, or adjacent to, the structurally delicate threads of the clamping screw.

Further, in accordance with the preferred embodiment of the invention, the slidably releasable shear pin and the clamping screw are cooperatively mounted in the hanger body by offsetting the pin and screw in the extent (thickness) of the body corresponding to lengthwise dimension of the sheet edge. Additionally, in this preferred form of the hanger, a flexible, dielectric shield is attached to the foot of one of the hanger legs so as to form a protective barrier at the opening of the slot, adjacent the inserted sheet, to prevent high velocity shot attendant shot peening processing of the sheet, from entering the slot and damaging the threads of the clamping screw. Also, for quick insertion, removal and locking/unlocking of the shear pin, an angle member is affixed to the noninserted end of the shear pin with a portion of such angle member extending parallel to the shear pin for being quickly clamped against and released from a face of the hanger body by a screw tightened locking knob.

To provide a complete disclosure of the invention, reference is made to the appended drawings and following detailed description of certain particular and presently preferred embodiments.

BRIEF DESCRIPTION OF THE DRAWINGS

FIG. 4 is a front elevational view of two of the hangers used for storing a partially processed sheet of material, in which the hangers support the sheet adjacent the upper edge thereof so that it depends downwardly between a pair of elevated, spaced parallel rails of a sheet storage rack.

FIG. 5 is an end view, partly in vertical section, of the hanger and hanger supporting rails of FIG. 4.

FIG. 6 is a front elevational view of the hanger of FIG. 1 supportively secured to the upper edge of a sheet, in which the hanger itself is in turn connected to and hung from the lower end of a rigid metal strap that is affixed to an electrically charged load bar at an electroprocessing station.

FIG. 7 is an end view, in elevation of the invention as it is shown in FIG. 6.

FIG. 8 is an enlarged, fragmentary view, partly in vertical section, showing an alternative construction of the clamping screw and its cooperation with the body of the hanger.

FIG. 9 is a bottom view of the hanger embodiment shown in FIG. 8 with a deflection shield at the lower opening to the hanger slot omitted for clarity.

DETAILED DESCRIPTION

Figure 1:
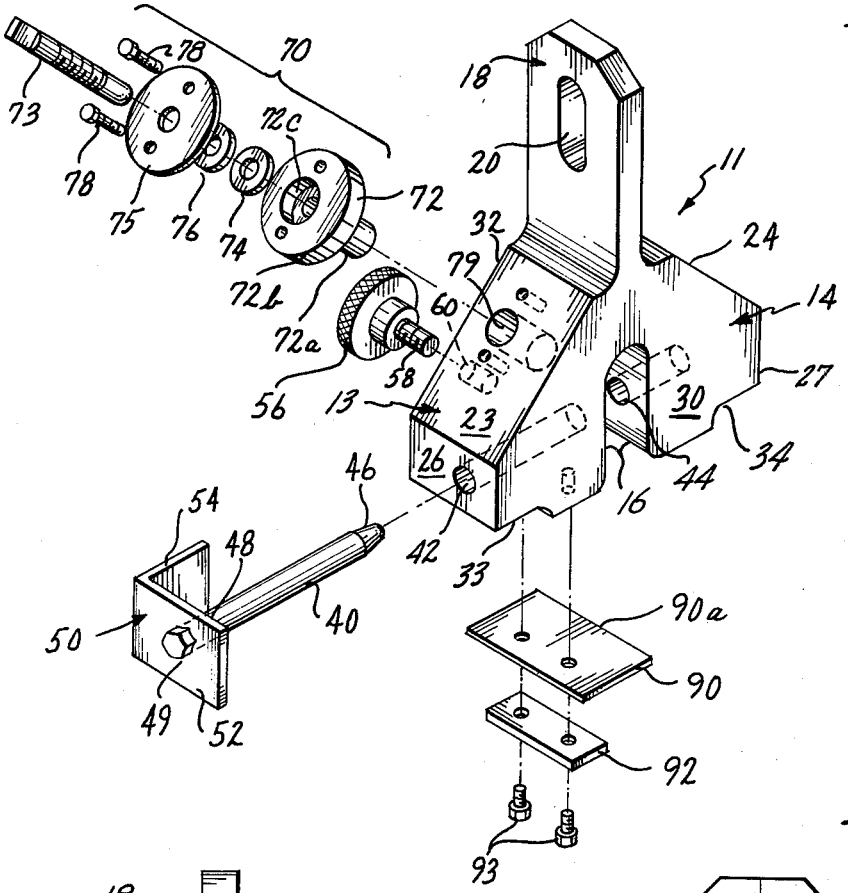
FIG. 1 is an exploded isometric view of the hanger constructed in accordance with one preferred form of the invention.

With reference to FIG. 1, the hanger 11, as currently preferred, has an inverted, generally Y-shaped body including downwardly oriented leg portions 13 and 14 separated by a centrally located material receiving slot 16. Adjacent the upper junction of leg portions 13 and 14, the body of hanger 11 is provided with an upwardly projecting lug portion 18. A vertically elongated opening 20 (for receiving a hook, bolt or other fastener) passes through lug portion 18 in a direction aligned with the leg portions 13 and 14, and hence transverse to width of slot 16.

Leg portions 13 and 14 have laterally and outwardly facing exterior surfaces 23 and 24, respectively, that begin proximate the base of lug portion 18 and slope downwardly and outwardly to a line of intersection with vertically oriented surfaces 26 and 27 at the outboard extents of the leg portions. The thickness of hanger 11 is the extent of the hanger body between end faces 30 and 32 of leg portions 13 and 14 as measured along the edge of the sheet of material received in slot 16. The end faces 30 and 32 are vertically oriented and parallel and continue upwardly to define the vertical edges of lug portion 18.

The lowermost extents of leg portions 13 and 14 are formed with recesses 33 and 34 adjacent the outboard surfaces 26 and 27. Recesses 33 and 34 are shaped, as described more fully hereinafter, for supportively resting on a pair of elevated, spaced parallel rails of a sheet storage rack.

Slot 16 has interior wall surfaces that extend in spaced parallelism upwardly into the body of hanger 11 and terminate at an upper extent above the height of outboard leg surfaces 26 and 27.

For supportively connecting hanger 11 to the sheet of material that is to be hung, a cylindrical shear pin 40 is inserted into horizontally aligned bores 42 and 44 provided in leg portions 13 and 14, respectively. Bore 42 extends perpendicularly and inwardly from outboard surface 26 on leg portion 13 and opens into slot 16 about mid-height thereof. The horizontally aligned bore 44 extends inwardly into the opposing wall surface of slot 16 in leg portion 14, and in this embodiment bottoms out at a location approximately mid-way across leg portion 14. To accommodate the clamping screw assembly, described below, pin receiving bores 42 and 44 are offset in leg portions 13 and 14 in the thickness dimension of hanger 11 between end faces 30 and 32, such that bores 42 and 44 are closer to end faces 30 than end face 32.

The insertable end 46 of pin 40 is pointed and the opposite end 48 has an L-shaped member 50, such as provided by a segment of angle stock, affixed to end 48 by a fastener 49 so that one leg 52 of member 50 is perpendicular to the axis of pin 40, and the remaining leg 54 of member 50 is parallel to and spaced from pin 40. The spacing of leg 54 from pin 40 is such that when the pin is inserted in bores 42 and 44, leg 54 is parallel and in sliding contact with end face 32 of the hanger body. Leg 54 of member 50 is thus arranged so that it slides between face 32 and a locking knob 56 (sometimes called a "locking wheel") that has a threaded stud 58 screwed into a matingly threaded hole 60 provided in leg portion 13 adjacent member 50. When pin 40 is fully inserted and the leg 52 of member 50 abutted against outboard surface 26 of leg portion 13, knob 56 may be tightened down to lock leg 54 against end face 32, thereby holding the pin in a locked condition. The flat shape of leg 52 of member 50 serves to limit the insertion of pin 40, and with the pin so inserted, as a protective shield, sealing off the end of bore 42 so as to prevent dirt, and other foreign substances from entering into the gap between pin 40 and bore 42. Also, the height of angle member 50 is somewhat greater than the height of outboard surface 26 of leg portion 13, so that the upper edge of member 50 can be grasped by the fingers and pulled outwardly after leg 54 has been released by loosening locking knob 56.

Cooperating with shear pin 40 is a clamping screw assembly 70 mounted on leg portion 13 of hanger 11 in offset relation to pin receiving bores 42 and 44. Assembly 70 includes an interiorally threaded tubular insert 72 made of a dielectric material, an exteriorally threaded clamping screw 73 made of a high strength metal, a set of three washers 74, 75 and 76 forming a seal between insert 72 and screw 73, and a pair of fastening bolts 78. Leg portion 13 of hanger 11 is formed with an insert receiving bore 79 entering the sloping surface 23 of portion 13 and extending perpendicularly inward thereof to surface 23 so as to open into slot 16 on the wall surface thereof adjacent leg portion 13.

Figure 2:
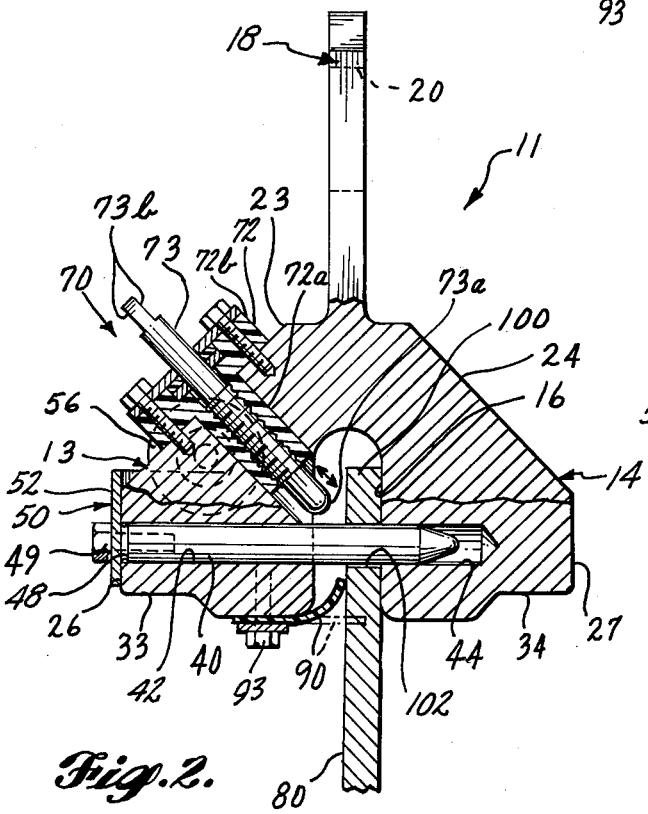
FIG. 2 is an end elevational view of the hanger of FIG. 1, partly in vertical section, and showing the cooperation of the hanger with an upper, apertured edge portion of a sheet of material supported by the hanger.

As shown in FIG. 2, the body of insert 72 is provided with a relatively elongate tubular portion **72*a* mated to the interior diameter of bore 72 for being inserted therein, and a larger annular head portion 72*b* forming a shoulder that seats against surface 23. A countersunk portion 72*c*, concentrically formed with the interior threaded opening of tubular portion 72*a* is provided for first receiving washer 74 made of a relatively hard material such as aluminum, and secondly a sealing washer 76 made of an elastomeric material such as neoprene. Washer 76 is compressibly sandwiched between washer 74, and an outer washer 75, also made of a relatively hard material such as aluminum, mated to the exterior face of insert portion 72*b*, and secured along therewith to the body of hanger 11 by a pair of fastening bolts 78 threaded into leg portion 13. A mid-shank portion of screw 73 is threaded as shown for cooperating with the interior threads of the tubular insert portion 72*a*. A sheet material engaging end 73*a* is rounded for abutting and jamming against one face of the sheet material 80 received within the slot 16, and the opposite end 73*b* of screw 73 is formed with opposed flats so as to be engagable by a wrench for forcibly rotating the screw into and out of jamming engagement with sheet 80. With sheet 80 jammed by screw 73 against the opposite interior wall surface of slot 16, positive electrical contact is obtained between the hanger body and sheet 80** for electroprocessing of the sheet as described more fully hereinafter.

Clamping screw assembly 70 including insert receiving bore 79 is horizontally offset, and in this embodiment angulated in the vertical plane, relative to shear pin 40 and pin receiving bores 42 and 44 to physically accommodate both the shear pin and screw clamp in the same leg portion 13, given the constraint of a limited thickness dimension of the hanger body. Screw 73 is made of a metal, selected to have relatively high strength, for effective clamping and yet be resistant to corrosion caused by the electrochemicals to which the hanger is exposed. An example of a suitable metal for screw 73 is titanium.

Figure 3:
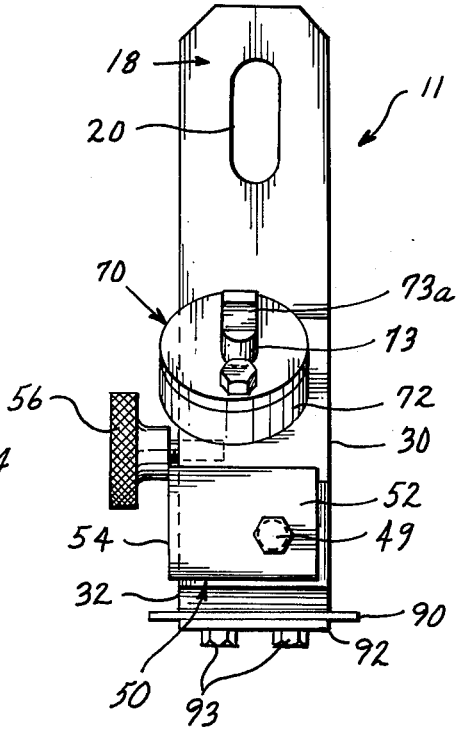
FIG. 3 is a side view in elevation of the hanger of FIG. 1.

A shot peening shield 90 is attached to the foot of leg portion 13 by means of a securement plate 92 and a pair of fastening screws 93. Shield 90 is made of an elastometric and dielectric material that is resistant to corrosive chemicals. Polypropylene, for example, has been found suitable. Shield 90 is arranged so that the unsupported edge **90*a* projects part way across the lower extent of slot 16 so as to permit the upper apertured edge of sheet 80 to be forced upwardly into slot 16 elastically deflecting shield 90 at edge 90*a* upwardly and inwardly into slot 16 as shown in FIG. 2. The dimension of shield 90 corresponding to the thickness of hanger 11 (i.e., measured in the direction of the edge of sheet 80) is selected to extend beyond the end faces 30 and 32 as shown in FIG. 3. Thus, when sheet 80 is inserted into slot 16, the opening to the slot from below the hanger is fully shielded. In use, shield 90 serves to protect the interior of slot 16 and more particularly the threads of both screw 73 and dielectric insert 72 from damage by peening shot thrown against the faces of sheet 80, which tend to be deflected upwardly into slot 16**.

While in general hanger 11 can be used in any situation in which there is a need to support a sheet of material for the purposes of processing, transporting or storing such sheet, the particular embodiment of hanger 11 as shown in FIGS. 1–3 is especially suited for use with sheets of aluminum that have been milled to form sections of the skin of an aircraft body. Such skin sections vary in thickness from approximately one-tenth of an inch to five-eighths of an inch and are generally elongated in one of the major dimensions so as to be suitable for being hung from one of the lengthwise edges. While the length and height of a skin section will vary widely, a typical skin section would be about four to six feet in height and fifteen to twenty feet in length.

The initial processing of the skin sheet is performed on a numerical controlled milling machine having a horizontal bed. During milling, each sheet is formed with edgewise projecting tabs such as shown by tabs 100 on the upper horizontal edge of skin sheet 80 of FIG. 4. Each tab 100 is provided with an attachment hole 102 transverse to the plane of the sheet (see FIG. 2) for cooperating with pin 40. Following certain post-milling procedures, such as the deburring of the milled surfaces of sheet 80, it is raised along one edge up off the horizontal bed or table upon which it rests, so as to allow hangers 11 to be fastened to the plurality of milled and drilled tabs 100. For this purpose, knob 56 of hanger 11 as shown in FIGS. 1–3 is loosened to allow angle member 50 and pin 40 to be withdrawn from its position traversing slot 16. The body of hanger 11 is then positioned so that the associated tab 100 of sheet 80 is slid into slot 16, and hole 102 in the tab is aligned with pin receiving bores 42 and 44. Shear pin 40 is then inserted by pressing on member 50 and when the pin is fully seated, knob 56 is tightened down on flange portion 54 locking the pin in place. A hanger 11 is thusly attached to each tab 100.

Now with the skin sheet 80 still partially raised, hoisting straps 104 having safety hooks 106 affixed to their lower ends are hooked onto the apertured lugs 18 of each hanger 11 so as to support and lift skin sheet 80 from an overhead hoist which may be mounted on overhead tracks or rails. Straps 104 are drawn upwardly by the overhead hoist raising skin sheet 80 completely off the table or bed and supporting sheet 80 in a downwardly depending vertical plane. In this position, sheet 80 is transported by overhead rails to a designated processing station, or to a storage rack as described below in connection with FIGS. 4 and 5.

In this particular example, skin sheet 80 is transported to and through a shot peening station. For the shot peening process, sheet 80 is transported slowly through a machine that propels shot in large quantities against the surface of the skin. Some of the shot is deflected upwardly toward tabs 100 and hangers 11. Because of this environment and to prevent the peening shot from flying upwardly into slot 16 of hanger 11 at high velocities and damaging the threads of clamping screw assembly 70 which opens into slot 16, the resiliently flexible shield 90 cooperates with sheet 80 to block off the bottom of slot 16 shielding the slot and screw assembly 70 from the peening shot.

After the shot peening process, skin sheet 80 is transported, while still supported by flexible straps 104 and hooks 106 and via overhead tracks to either the next processing station, or to a rack 108 as is shown in FIGS. 4 and 5 for temporary storage of one or more sheets 80. Rack 108 includes a plurality of spaced parallel rails 110 and 112 that are elevated above the floor of the plant by stanchions 114, the lower ends of which are fixed to either a stationary, or mobile base 116. A mobile base 116 allows the rack 108 to be used as a cart to transport sheets 80 about the plant while they remain hung on rails 110 and 112.

Parallel rails 110 and 112 are shaped to mate with the recesses 33 and 34 on the feet of leg portions 13 and 14 of hanger 11 (see FIGS. 1 and 2), and by means of operating the overhead hoist, straps 104 and the associated hooks 106 are manipulated to position sheet 80 above the rack, in the vertical plane that extends between rails 110 and 112. The sheet is then lowered to drop it down inbetween rails 110 and 112 and stanchions 114 until recesses 33 and 34 of hanger 11 seat on the upper and inwardly adjacent surface portions of rails 110 and 112. It is observed that the lower edge 120 of sheet 80 is suspended above base 116 and hence edge 120 need not be level with base 116 or the plant floor. Although not shown here, edge 120 can have fragile projections or other edge structure that would be damaged if sheet 80 were allowed to rest on its lower edge. When hanger 11 and the depending sheet 80 are thus supported on elevated rails 110 and 112, the hoisting straps 104 and associated hooks 106 may be released from lugs 18 and used elsewhere while sheet 80 remains protectively stored, awaiting further processing.

One of the subsequent processing stages includes elctroprocessing of the skin sheet 80. For example, in this particular example sheet 80 is an aluminum skin and is to be anodized. For this purpose, sheet 80 must be lowered into a tank (not shown) containing an electrochemical solution and then electrically charged.

With reference to FIGS. 6 and 7, the anodizing operation is performed by attaching lug 18 of each of hangers 11 to a horizontally supported overhead load bar 130 that serves to both support the weight of skin sheet 80 and as an electrical connection for supplying an electrical charge thereto. Lug 18 may be directly connected to load bar 130 or indirectly as shown in FIGS. 6 and 7 by one or more auxillary straps 132 made of an electrically conductive metal, such as aluminum. Strap 132 has a sufficient cross section so as to be relatively rigid and capable of transmitting torgue between load bar 130 and a lug 18 of hanger 11 to prevent twisting of hanger 11 which might lead to buckling of sheet 80. The lower end of strap 132 is mechanically and electrically fastened to the apertured lug 18 by nut and bolt fastener 134, and in a similar manner the upper end of strap 132 is mechanically and electrically attached to load bar 130 by nut and bolt fastener 136. The upper end fastener 136 cooperates with a downwardly depending and horizontally slotted flange 138 that is electrically and mechanically affixed such as by welding, to the lower surface of a metal pipe 140 by means of an interposed channel 142. Pipe 140 is electrically charged relatively to the electrolytic solution in the tank (not shown), and current flows from a potential source attached to pipe 140 through channel 142, flange 138 and strap 132 to the lug 18 of the depending hanger 11. For this reason it is important that a good electrical contact be provided at each connection.

With hanger 11 and sheet 80 thus physically supported from load bar 130 and in electrical contact therewith, it is still necessary to ensure direct electrical contact between the body of hanger 11 and the surface of aluminum sheet 80. For this purpose, screw 73 of the clamping screw assembly 70 is now tightened. By doint so, the sheet engaging end 73*a* of screw 73 as shown in FIG. 2 is jammed downwardly and inwardly against the adjacent surface of tab 100 of sheet 80 forcing the opposing surface of tab 100 against the opposite interior wall surface of slot 16. Even though screw 73 itself is made of a metal, in order to provide the strength and chemical resistant properties needed in the environment in which hanger 11 is used, the electrical conductivity of the screw does not carry any of the current that is needed to be conducted by hanger 11 between load bar 130 and aluminum sheet 80. Rather, the current from the load bar passes to lug 18 and hence primarily through leg portion 14 of the hanger and onto sheet 80 through the face-to-face contact between the flat face of tab 100 and the interior wall of slot 16 in contact therewith. Moreover, since the exterior threads of the conductive screw 73 are engaged with the interior threads of dielectric insert 72, there is no electrical conduction across the threaded engagement of these two parts, and hence the possibility of electrochemical corrosion to these threads is minimized.

In most cases, the aluminum skin sections are milled such that one edge is substantially straight as in the case of the upper edge of skin sheet 80, so that each of the hangers 11 can be located at a uniform distance below the load bar 130. However, in some situations, the upper edge of sheet 80 may be irregular, such as slanted, and in that situation, various lengths of auxillary straps 132 are used to match the required distance between flange 138 and the elevation of the underlying hanger 11. Also, it may be desirable in some instances to connect an auxillary strap, such as strap 132 directly to the apertured tab 100 using a bolt and nut fastener to provide an upward extension of the sheet tab, and so one of hangers 11 can be attached to the upper apertured end of the thusly connected auxillary strap for hanging the sheet via the intervening strap. In that case, the apertured lug 18 of the hanger can be directly, or again indirectly through another auxillary strap, attached to the flange 138 of load bar 130.

In all of the foregoing examples, it will be appreciated that sheet 80 is both physically supported from the overhead load bar 130, and electrically in contact therewith. The need for an auxillary electrode cable and associated auxillary electrical clamp, as has been used in some previous electrochemical processes to electrically charge skin sheet 80, is eliminated by using hanger 11.

From the electrochemical processing station, sheet 80 is transported, again in the manner described above using flexible straps 104 and hooks 106, to either the next processing station, or again back to the storage or cart rack 108 as shown by FIGS. 4 and 5 and described above. Assuming that the next processing station involves the automatic spray painting of the skin sheet 80, hangers 11 with or without the auxillary straps 132 are connected to an elongate rigid overhead support structure similar to load bar 130 which is capable of conveying the sheet 80 through a paint spraying station. In such case, it is essential that sheet 80 be maintained in a perfectly planar configuration, without buckling along its length, in order to ensure the uniform application of paint from automatic paint sprayers. For this purpose, a relatively rigid, torque transmitting connection, such as described above with respect to strap 132, must be provided between lug 18 of each of hangers 11 and the overhead parallel support from which the upper edge of sheet 80 is hung.

Following the painting operation, the skin sheet is either temporarily stored or transported directly to a curing station. The sheet 80 is cured by moving it slowly through an oven while the sheet is held in a vertical plane by hangers 11.

After curing, hangers 11 are removed from tabs 100 of sheet 80, and the tabs themselves are cut off, and the resulting severed tab location is hand processed to complete the sheet. Hangers 11 that are removed from the thusly completed sheet 80 are cleansed in a nitric acid bath to remove paint and clean off any excess residue left from the electrochemical processing. For this reason, the various metal and dielectric components of hanger 11 are made of materials resistant to nitric acid, such as aluminum for the hanger body, titanium for screw 73, and polypropylene for shield 90.

ALTERNATIVE EMBODIMENT

In some applications the strength of a metal clamping screw 73 (as shown in FIG. 2) is not required, and another version of the hanger, shown by hanger 11' in FIGS. 8 and 9, is preferred. Like reference numerals with a prime notation are used to indicate parts that correspond to those in the above-described embodiment of hanger 11 shown in FIGS. 1–3. In this embodiment, the angulated clamping screw assembly 70 including metal screw 73, is replaced by a screw 150 made of a dielectric material and cooperating with an interiorally threaded bore 152 provided in the opposite leg portion 14' from the retractable end of shear pin 40'. More particularly, bore 152 is formed in generally the same horizontal plane as pin receiving openings 42' and 44', but is horizontally offset therefrom, i.e., in the dimension of hanger 11' between end faces 30 and 32, as in the case of the offset between clamping screw assembly 70 and shear pin 40 of hanger 11 as described above.

A rounded end 154 of bolt 150 projects inwardly from the adjacent interior surface of slot 16' so as to jam the apertured sheet 80' against the opposite interior wall surface of slot 16'. The opposite end of bolt 150 is formed with a wrench engagable head 156, such as the illustrated octagonal head, suitable for being engaged and turned by a socket wrench. When fully screwed into threaded bore 152, head 156 of bolt 150 is generally recessed with respect to the outboard surface 27' of leg portion 14' within a countersink bore 158 concentric with bore 152 and having a diameter sufficient to accommodate the exterior diameter of a socket used for turning bolt head 156.

Inasmuch as the bolt 150 travels along a direction perpendicular to sheet 80', rather than at an oblique angle, an effective clamping force can be achieved by the screw 150 even though the threads of bolt 150 are of a dielectric material, such as polypropylene or other synthetic material of similar dielectric and strength characteristics.

Since clamping screw 150 has been relocated so as to force sheet 80' against the opposite interior wall of slot 16', the elastomeric shield 90' including the fastening assembly of plate 92' and screws 93' is moved so as to be fastened to leg portion 14' for blocking off the opening into slot 16' between sheet 80' and the entry location of bolt 150 into slot 16' as shown in FIG. 8. For clarity, shield 90', plate 92' and fasteners 93' have been omitted from the bottom view of hanger 11' depicted in FIG. 9.

While only particular embodiments have been disclosed herein, it will be readily apparent to persons skilled in the art that numerous changes and modifications can be made thereto including the use of equivalent means and devices without departing from the spirit of the invention.

The embodiments of the invention in which an exclusive property or privilege is claimed are defined as follows:

1. An electrically conductive hanger for engaging sheet metal material from an upper edge portion thereof and for cooperating with an overhead hanger support fitting and with spaced parallel hanger supports so as to supportively hang such material during handling and electroprocessing thereof, in which such sheet metal material has a hanger cooperating opening provided adjacent such upper edge portion, comprising:

an inverted Y-shaped body made of electrically conductive material and including a downwardly oriented bifurcation that forms first and second legs that bound a centrally located sheet receiving slot, feet means formed on said legs adapted for suportively resting on spaced parallel hanger supports, and an upwardly projecting attachment portion adapted for receiving a cooperating hanger support fitting;

releasable shear pin means cooperating with said legs and slot for releasably hanging the sheet metal material by engaging an opening provided in such sheet material adjacent an upper edge portion thereof when such upper edge portion is disposed in said receiving slot of said body; and, clamping screw means cooperating with said body and slot therein for jamming a surface of such sheet material when disposed in said slot, against an interior wall of said slot.

2. The hanger of claim 1 wherein said feet means on said legs are formed with recessed portions for cooperative seating on spaced parallel supports.

3. The hanger of claim 1 wherein said releasable shear pin means comprises a shear pin and pin receiving openings extending in said legs in a direction transverse to said slot, wherein said opening in one of said legs extends through to a laterally outboard surface of said leg for receiving an insertable end of said pin, and wherein structure means is affixed to an opposite end of said pin and said structure means has a flange portion which slides in juxtaposition with a surface of said body when said pin is inserted in said pin receiving openings, and manual locking screw means threadedly engaging said body adjacent said portion of said structure means for releasably securing said flange portion and hence said pin against movement relative to said body.

4. The hanger of claim 1 wherein said clamping screw means includes a screw and means for insulating the threads of said screw from said body.

5. The hanger of claim 4 wherein said clamping screw means comprises a bore provided in said body extending from an outboard surface of one of said legs and opening into said slot, an interiorly threaded dielectric sleeve fixedly mounted in said bore of said body, and a screw threadedly engaged with said interiorly threaded sleeve.

6. The hanger of claim 1 wherein said clamping screw means is offset in said body from said shear pin means so both said screw means and shear pin means enter said slot in a non-interfering relationship for separately engaging a sheet of material received in said slot.

7. The hanger of claim 1 further comprising a resiliently flexible shield mounted to said body and extending partially across the downwardly facing opening of said slot between said legs.

8. The hanger of claim 4 wherein said clamping screw means comprises an interiorly threaded bore extending through one of said legs of said body, and a cooperating screw having exterior threads made of a dielectric material.

9. The hanger of claim 1 wherein said first leg has a lateral, exterior surface that slopes downwardly and away from said attachment portion to an outboard extent of said leg, and said clamping screw means includes an interiorly threaded bore extending inwardly of said exterior surface of said leg and opening into said slot adjacent to but offset from said shear pin means.

10. The hanger of claim 9 wherein said threaded bore of said clamping screw means and said shear pin means are disposed in said first leg of said body and are offset in the direction of said body that corresponds to the lengthwise edge of the sheet of material that is to be received in said slot.

11. A hanger for supporting sheet material from a hanger support fitting and from spaced parallel hanger supports, in which such sheet material has a hanger cooperating opening provided adjacent such upper edge portion, comprising:

an inverted Y-shaped body including a downwardly oriented bifurcation thatforms first and second legs that bound a centrally located sheet receiving slot, feet means formed on said legs adapted for supportively resting on spaced parallel supports, and an upwardly projecting attachment portion adapted for receiving a cooperating hanger support fitting; and, releasable shear pin means cooperating with said legs and slot for releasably hanging the sheet material by engaging an opening provided in such sheet material adjacent an upper edge thereof when such upper edge portion of the sheet material is disposed in said slot.

12. The hanger of claim 11 wherein said feet means on said legs are formed with recessed portions for cooperative seating on spaced parallel supports.

13. The hanger of claim 11 wherein said releasable shear pin means comprises a shear pin and pin receiving openings extending in said legs in a direction transverse to said slot, wherein the opening in one of said legs extends through to a laterally outboard surface of said leg for receiving an insertable end of said pin, and wherein structure means is affixed to the opposite end of said pin and said structure means has a flange portion which slides in contact with a surface of said body when said pin is inserted in said pin receiving openings, and manual locking screw means threadedly engaging said body adjacent said flange portion of said structure means for releasably securing said flange portion and hence said pin against movement relative to said body.

14. The hanger of claim 13, wherein said structure means is an L-shaped member sized and arranged so as to be manually grasped for inserting and retracting said pin.

15. The hanger of claim 11 further comprising, clamping screw means cooperating with said legs and slot therein for jamming a surface of such sheet material against an interior wall of said slot, and wherein said clamping screw means is offset in said body from said shear pin means so both said screw means and shear pin means enter said slot in a non-interfering relationship for separately engaging a sheet of material disposed in said slot.

16. The hanger of claim 15 wherein said first leg has a lateral, exterior surface that slopes downwardly and away from said attachment portion to an outboard extent of said leg, and said clamping screw means includes an interiorly threaded bore extending inwardly of said exterior surface of said leg and opening into said slot adjacent to but offset from said shear pin means.

17. The hanger of claim 16 wherein said threaded bore of said clamping screw means and said shear pin means are disposed in said first leg of said body and are offset in the direction of said body that corresponds to the lengthwise edge of the sheet of material that is to be received in said slot.

* * * * *